US006295800B1

(12) United States Patent
Stahlecker

(10) Patent No.: US 6,295,800 B1
(45) Date of Patent: Oct. 2, 2001

(54) APPARATUS FOR OPEN-END SPINNING

(75) Inventor: Fritz Stahlecker, Josef-Neidhart-Strasse 18, 73337 Bad Überkingen (DE)

(73) Assignees: Fritz Stahlecker, Bad Überkingen; Hans Stahlecker, Süssen, both of (DE)

( * ) Notice: Subject to any disclaimer, the term of this patent is extended or adjusted under 35 U.S.C. 154(b) by 0 days.

(21) Appl. No.: 09/436,757

(22) Filed: Nov. 9, 1999

(30) Foreign Application Priority Data

Dec. 11, 1998 (DE) ..... 198 57 160

(51) Int. Cl.[7] ..... D01H 4/00

(52) U.S. Cl. ..... 57/411; 57/406; 57/408; 57/413; 57/414; 57/415; 57/417

(58) Field of Search ..... 57/406, 408, 411, 57/413, 414, 415, 417

(56) References Cited

U.S. PATENT DOCUMENTS 3,511,044 * 5/1970 Stary ..... 57/411
5,065,572 * 11/1991 Stahlecker ..... 57/413
5,109,633 * 5/1992 Stahlecker et al. ..... 57/413
5,117,622 * 6/1992 Stahlecker ..... 57/411
5,867,975 * 2/1999 Breitenhuber et al. ..... 57/413

* cited by examiner

*Primary Examiner*—John J. Calvert
*Assistant Examiner*—Shaun R Hurley
(74) *Attorney, Agent, or Firm*—Crowell & Moring LLP

(57) ABSTRACT

In the case of an apparatus for open-end spinning, a fiber feed channel is arranged between an opening roller and a spinning rotor, which fiber feed channel tapers in a transport direction and which comprises a deflecting zone on its transport path. Immediately after the beginning of the deflecting zone, a bypass opening is provided, through which opening a part of the suction airflow transporting the fibers to the spinning rotor is drawn off. In the area of the opening roller, a bypass air inlet opening is provided additionally to support the suction airflow.

19 Claims, 1 Drawing Sheet

APPARATUS FOR OPEN-END SPINNING

BACKGROUND AND SUMMARY OF THE INVENTION

This application claims the priority of German application 198 57 160.7, filed in Germany on Dec. 11, 1998, the disclosure of which is expressly incorporated by reference herein.

The present invention relates to an apparatus for open-end spinning comprising an opening roller, a spinning rotor and a fiber feed channel for transporting fibers by means of a suction airflow from the opening roller to the spinning rotor, said fiber feed channel tapering in a fiber transport direction, having a deflecting zone on its transport path, and being provided, at a distance upstream from its narrowest cross section, with a bypass opening for drawing off a part of the suction airflow.

An apparatus of this type is prior art in U.S. Pat. No. 5,065,572. In the case of such an apparatus, the largest possible amount of suction airflow is desired, so that no disturbances in the fiber transport, nor any fly contamination in the area of the opening roller, can occur. The amount of air in the suction airflow is set, however, by the narrowest cross section, which as a rule is located at the exit opening, and determined also by the installed vacuum. For energy-saving reasons, the pressure differences are kept at a minimum. The narrowest cross section is, however, limited by the diameter of the spinning rotor, which diameter, at the current standard speeds of 130,000 rpm and more, lies clearly below 30 mm. Small exit openings result, however, as mentioned above, in fly contamination in the area of the opening roller.

By means of the bypass opening known from the above mentioned prior art, the suction cross section in the area of the opening roller can be enlarged, so that, despite a narrow diameter at the exit mouth of the fiber feed channel, a sufficiently large amount of air can be sucked in. A part of the suction air flow is already drawn off by means of the bypass opening before it reaches the narrowest cross section. As the bypass opening is disposed in transport direction downstream of the deflecting zone in the case of the known apparatus, the aim is to prevent any fibers being drawn off with the air through the bypass opening, and that all fibers reach the exit opening and thus are disposed in the spinning rotor. It has been shown, however, that a part of the fibers are drawn off with the outgoing air through the bypass opening.

It is an object of the present invention to avoid the disadvantages present in the embodiment of the above mentioned apparatus and to ensure that, while maintaining the advantages of the known bypass opening, no fibers are prematurely drawn off, but rather that all fibers reach the spinning rotor.

This object has been achieved in accordance with the present invention in that the bypass opening is arranged immediately after the beginning of the deflecting zone, in an area which is substantially free of fibers.

The present invention is based on the knowledge that the inertia of the fibers in the suction airflow is so great that the fibers require a distance, even if only a short one, downstream of the deflecting zone until they are distributed over the whole cross-section of the fiber feed channel. If the bypass opening is arranged immediately after the beginning of the deflecting zone, said bypass opening being preferably the entry opening of the outgoing air duct, which is directed in the opposite direction to the transport direction of the fiber feed channel, it can then be presumed that all fibers are guided past the bypass opening without being drawn off in an undesired way.

Often fiber feed channels are made up of several channel sections, for example when the area of the exit opening is arranged in a separate adapter, which is adapted to the particular dimensions of a spinning rotor. In an advantageous embodiment of the present invention, the fiber feed channel consists thus of two channel sections, having at the deflecting zone a partition seam, at which the bypass opening is located. In this way, the deflecting zone can be constructed in a technically practical way, whereby the fiber feed channel, as a rule, is bent at the deflecting zone.

It is favorable when the exit opening of the fiber feed channel and the bypass opening are both connected to a joint vacuum source. This can be the vacuum source to which the spinning rotor is connected anyway for the generation of the necessary suction airflow.

As mentioned above, a sufficiently large amount of air should be present in the area of the opening roller. The in-going air in this area is fed usually through a trash removal opening located on the periphery of the opening roller. Exactly at this point, however, it is not desirable to have too high a suction airflow speed, so that the removal of light trash particles is not impeded. It is known from U.S. Pat. No. 5,809,766 that the air speed at the trash removal opening is effectively reduced in that downstream of the trash removal opening, but at a significant distance from the start of the fiber feed channel, an additional inlet air opening is provided. This additional opening, in a further embodiment of the present invention, can be a bypass air inlet opening which supports the suction airflow. Thus the amount of air is increased in a desired way there where the fibers are released from the opening roller and enter into the fiber feed channel, without, if a trash removal opening is present, the air speed being too greatly increased at this point. This so-called double bypass results, as has been shown, in a favorable balance of air streams in the fiber feed channel.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
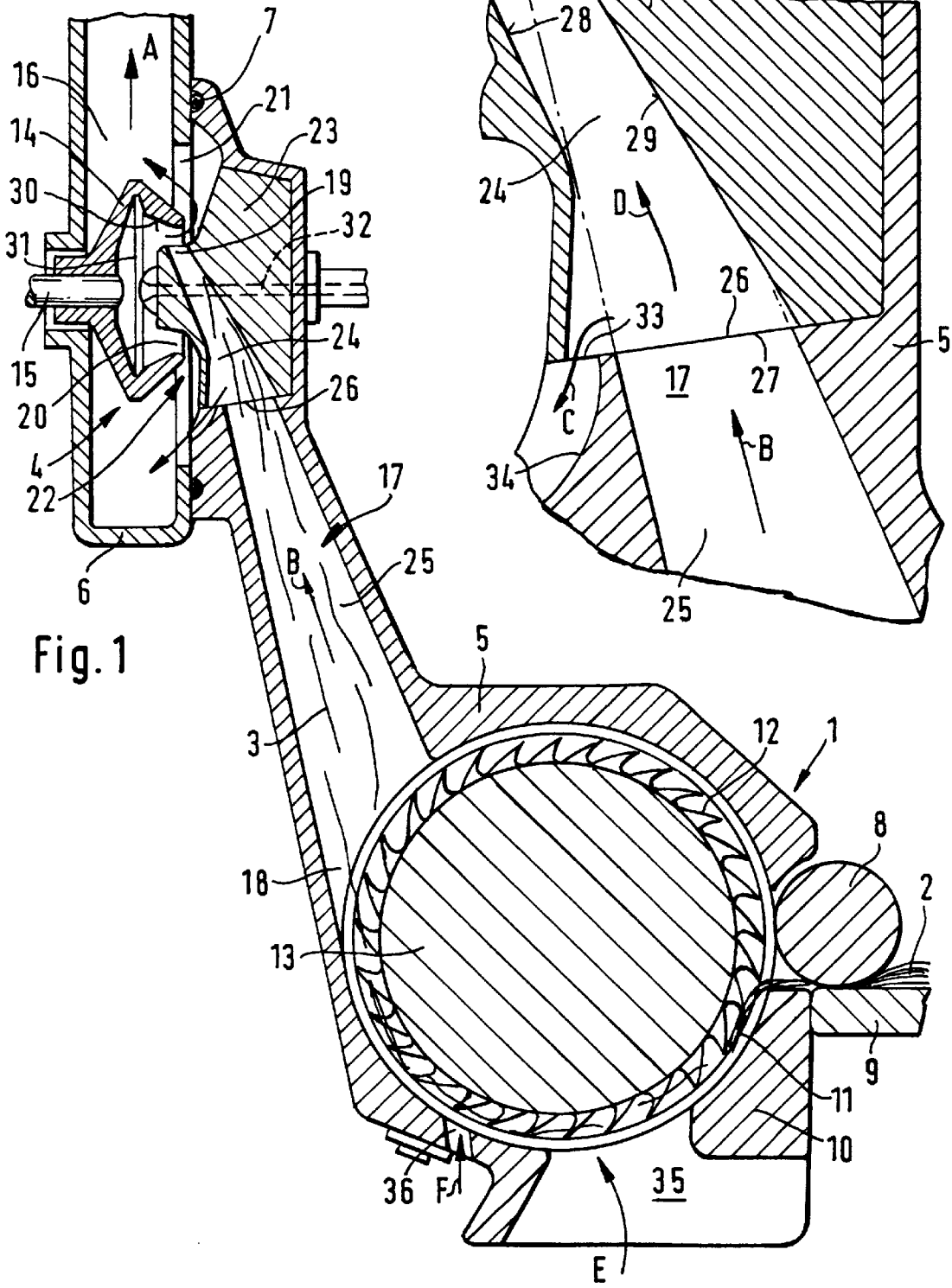
FIG. 1 is a sectional side view of an apparatus for open-end spinning according to the present invention.

The apparatus for open-end spinning comprises a feed and opening device 1, with which in the known way a fed sliver 2 is opened to single fibers 3 and fed in this form to the actual spinning aggregate 4, in which the yarn is spun (not shown).

The feed and opening device 1 comprises a swivel housing 5, which can be swivelled around a swivel axle (not shown), said swivel housing 5 being disposed during operation by means of an intermediary ring sealing 7 on a stationarily arranged rotor housing 6.

The sliver 2, before being opened into single fibers 3, is fed by means of a feed roller 8, to which a feed table 9 is arranged in a known way, which can be swivelled and pressed against the feed roller 8 by means of the action of a loading spring (not shown). A stationary fiber beard support 10 is arranged downstream of the feed roller 8, with which fiber beard support 10 the end of the sliver 2 to be opened, the so-called fiber beard 11, is pressed into the combing structure 12 of a rapidly rotating opening roller 13. The combing structure 12 comprises in the known way of needles or saw teeth.

A rapidly rotating spinning rotor 14 is located in the rotor housing 6, which spinning rotor 14 is pressed onto a shaft 15, which penetrates in a sealed way through the back wall of the rotor housing 6. The shaft 15 is driven and supported outside of the rotor housing 6 in a way not shown.

The rotor housing 6 surrounds a vacuum chamber 16, in which the spinning rotor 14 is arranged. The vacuum chamber 16 is suctioned, for which purpose the rotor housing 6 is connected to a vacuum source (not shown). The suction direction is shown by the arrow A.

A fiber feed channel 17 connects the opening roller 13 with the spinning rotor 14. The fiber feed channel 17, tapering in transport direction B, serves to guide a suction airflow, generated by the vacuum source, with which airflow the single fibers 3 individualized by the opening roller 13 are fed to the spinning rotor 14. The start 18 of the fiber feed channel 17 is located at that point of the opening roller 13 at which the fibers 3 are released due to centrifugal forces, whereby the releasing process is supported by as large a suction airflow as possible. The exit opening 19, which is simultaneously the narrowest cross section of the fiber feed channel 17, is located in the inside of the spinning rotor 14. The spinning rotor 14 has an open front side 20, into which the exit opening 19 of the fiber feed channel 17 projects.

The rotor housing 6 has an opening 21 on the operator's side which is larger than the largest diameter of the spinning rotor 14. The spinning rotor 14 can be assembled and disassembled through this opening 21. During operation, this opening 21 is closed by means of an extension of the swivel housing 5, which extension is provided with the ring sealing 7. On the open front side 20, however, an overflow gap 22 is retained, so that the vacuum present in the rotor housing 6 is also present in the inside of the spinning rotor 14. The suction airflow is drawn off through this overflow gap 22 in arrow direction A, without any of the fibers 3 to be spun being drawn off with it.

The area of the exit opening 19 of the fiber feed channel 17 is located in a so-called adapter 23, which is arranged at the last part of the fiber feed channel 17 and which is a component part of the swivel housing 5. Thus in the adapter 23 is located a channel section 24 which forms the end part of the fiber feed channel 17, while the first area of the fiber feed channel 17 is formed by a channel section 25 located in the swivel housing 5. Between the two channel sections 24 and 25, that is at the partition area between the adapter 23 and the remaining part of the swivel housing 5, is located a partition seam 26, which forms at the same time a deflecting zone 27 of the fiber feed channel 17. The area of this deflecting zone 27 can be seen more clearly in FIG. 2, whereby the dot-dash lines show the intended extension of the channel section 25, from which the direction of the next channel section 24 clearly deviates. From the deflecting zone 27 onwards there is thus an inner path 28 and an outer path 29 in the channel section 24 of the fiber feed channel 17 for the fibers 3 to be transported in the suction airflow.

It is an object of the present invention that the fibers 3 at the deflecting zone 27 reach the outer path 29; in any case, however, that they have a safe distance from the inner path 28 directly downstream of the deflecting zone 27. The fibers 3 exiting from the exit opening 19 reach a conically widening sliding wall 30 located in the inside of the spinning rotor 14, from which sliding wall 30 they reach the so-called fiber collecting groove 31, which defines the largest inner diameter measurement of the spinning rotor 14. In the fiber collecting groove 31, the fibers 3 collect to form a fiber ring in the known way, from which the spun yarn is withdrawn by means of a yarn withdrawal duct 23 located in the adapter 23.

In general, the narrowest cross section of the fiber feed channel 17 is present at the exit opening 19. Even when, as is often the case, the last part of the channel section 24 does not taper, but is rather cylindrically formed, the narrowest cross section is located at least not far from the exit opening 19.

If the spinning rotor 14 has a very small diameter, and the vacuum is not to be increased, then the amount of air in the suction airflow which exits out of the exit opening 19 is limited. On the other hand, it is an aim to have a sufficiently large amount of air at the beginning 18 of the fiber feed channel 17, so that the fibers 3 can be released efficiently from the combing structure 12 of the opening roller 13 and so that there is no undesirable fly contamination in the area of the feed and opening device 1.

Figure 2:
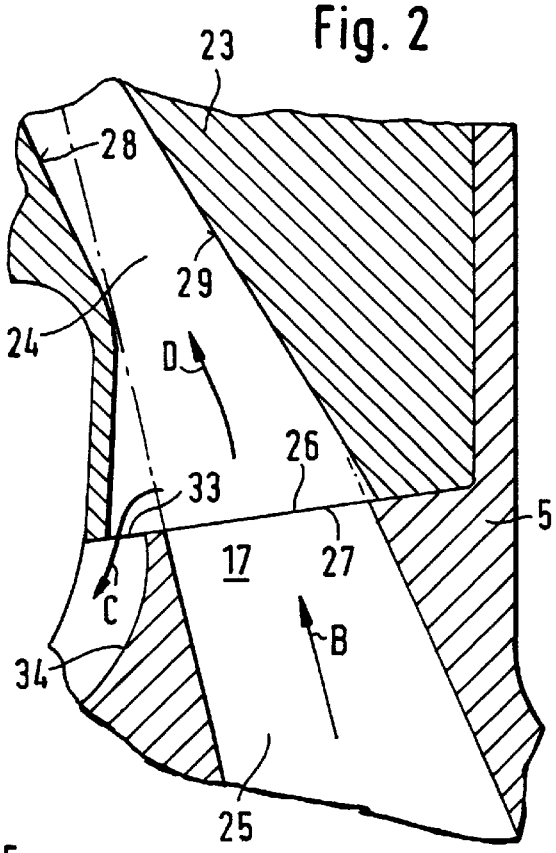
FIG. 2 is in greatly enlarged dimensions a partial view of FIG. 1 in the area of the deflecting zone of the fiber feed channel.

As a solution to these problems it is already known to provide the fiber feed channel 17 with a bypass opening, by means of which a part of the suction airflow is drawn off before it reaches the exit opening 19. As shown in FIG. 2, the position and embodiment of the bypass opening 33 is designed in a particular way according to the present invention.

As already mentioned above, the bypass opening 33 is located at a distance upstream from the narrowest cross-section of the fiber feed channel 17, that is, at a zone where the cross-section of the fiber feed channel 17 is still large enough to guide through an amount of air considered sufficient. The bypass opening 33, according to the present invention, is now located immediately after the beginning of the deflecting zone 27 of the fiber feed channel 17, that is in the area of the partition seam 26 of the channel sections 24 and 25. Furthermore, the bypass opening 33, as is known, is applied to the inner path 28 of the channel section 24. A certain amount of the suction airflow, denoted by the arrow C, is drawn off through the bypass opening 33, while the remaining amount D of the suction airflow, which is permitted by the dimensions of the components, flows through the exit opening 19.

The bypass opening 33 is designed as the entry opening to an air outlet duct 34, which is directed opposite to the transport direction B of the suction airflow. In the present case the air outlet duct 34 is open on one side, so that the outgoing air is guided directly into the vacuum chamber 16 of the rotor housing 6 and from there to the vacuum source.

It is thus important that the bypass opening 33 is located immediately after the beginning of the deflecting zone 27 and at the same time on the inner path 28 of the fiber feed channel 17, so that so few fibers as possible are lost through the bypass opening 33, that is, that only outgoing air is withdrawn. At the zone of the bypass opening 33, the fibers are most probably located still on the outer path 29 of the fiber feed channel 17 and reach the inner path 28 again only when traveling further along the channel section 24. The bypass opening 33 must in any case be located upstream of such a critical zone.

As can be seen from FIG. 1, there is a trash removal opening 35 between the fiber beard support 10 and the beginning 18 of the fiber feed channel 17, through which opening 35 trash particles present in the sliver 2 are removed in a known way, while the lighter fibers 3 follow the periphery of the opening roller 13 up to the fiber feed channel 17. Usually, a greater portion of the incoming air is fed through the trash removal opening 35 according to arrow direction E. The speed of the incoming air E should, however, only be so high as to not prevent the removal of light trash particles. For this reason, adjoining the trash removal opening 35, but at a distance from the beginning 18 of the fiber feed channel 17, is a bypass air inlet opening 36, in which an additional, smaller amount of incoming air is fed. The amount of this additional incoming air F can be regulated by means of a sliding valve or the like. Thus, by means of the bypass air inlet opening 36, the efficiency of the trash removal at the trash removal opening 35 is not only improved, but rather furthermore the suction airflow in the fiber feed channel 17 is additionally supported.

A combination of the bypass opening 33 according to the present invention together with the bypass air inlet opening 36 is thus particularly advantageous for the present invention.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus for open-end spinning comprising:

an opening roller, a spinning rotor, a fiber feed channel for transporting fibers using a suction airflow from the opening roller to the spinning rotor, and a bypass air inlet opening located in an area of the opening roller and operable to support the suction airflow into the fiber feed channel;

wherein said fiber feed channel tapers in a fiber transport direction, and has a deflecting zone on its transport path formed by adjoining fiber feed channel sections defining fiber feed paths inclined with respect to one another, wherein a bypass opening for drawing off a part of the suction airflow is provided at a distance upstream from a narrowest cross section at the fiber feed channel, wherein said bypass opening is arranged immediately after the beginning of the deflecting zone in an area which is substantially free of fibers due to deflection of the travel path of the fibers at the deflecting zone, and wherein the opening roller is disposed in an opening roller housing, which has a trash removal opening disposed ahead of the bypass air inlet opening with respect to an opening roller movement direction.

2. An apparatus according to claim 1, wherein an exit opening of the fiber feed channel and the bypass opening are connected to a joint vacuum source.

3. An apparatus for open-end spinning comprising:

an opening roller, a spinning rotor, and a fiber feed channel for transporting fibers using a suction airflow from the opening roller to the spinning rotor, wherein said fiber feed channel tapers in a fiber transport direction, and has a deflecting zone on its transport path formed by adjoining fiber feed channel sections defining fiber feed paths inclined with respect to one another, wherein a bypass opening for drawing off a part of the suction airflow is provided at a distance upstream from a narrowest cross section at the fiber feed channel, and wherein said bypass opening is arranged immediately after the beginning of the deflecting zone in an area which is substantially free of fibers due to deflection of the travel path of the fibers at the deflecting zone, wherein the bypass opening is an air inlet opening of an air outlet duct which is directed opposite to the transport direction of the fiber feed channel.

4. An apparatus according to claim 2, wherein the fiber feed channel comprises two channel sections and has at the deflecting zone a partition seam at which the bypass opening is located.

5. An apparatus according to claim 4, wherein an exit opening of the fiber feed channel and the bypass opening are connected to a joint vacuum source.

6. An apparatus according to claim 2, wherein an exit opening of the fiber feed channel and the bypass opening are connected to a joint vacuum source.

7. An apparatus according to claim 3, comprising a bypass air inlet opening located in an area of the opening roller and operable to support the suction airflow into the fiber feed channel.

8. An apparatus according to claim 7, wherein the opening roller is disposed in an opening roller housing, which has a trash removal opening disposed ahead of the bypass air inlet opening with respect to an opening roller movement direction.

9. An apparatus for open-end spinning comprising:

an opening roller, a spinning rotor, and a fiber feed channel for transporting fibers using a suction airflow from the opening roller to the spinning rotor, wherein said fiber feed channel tapers in a fiber transport direction, and has a deflecting zone on its transport path formed by adjoining fiber feed channel sections defining fiber feed paths inclined with respect to one another, wherein a bypass opening for drawing off a part of the suction airflow is provided at a distance upstream from a narrowest cross section at the fiber feed channel, and wherein said bypass opening is arranged immediately after the beginning of the deflecting zone in an area which is substantially free of fibers due to deflection of the travel path of the fibers at the deflecting zone, wherein the fiber feed channel comprises two channel sections and has at the deflecting zone a partition seam at which the bypass opening is located.

10. An apparatus according to claim 9, wherein an exit opening of the fiber feed channel and the bypass opening are connected to a joint vacuum source.

11. An apparatus according to claim 9, comprising a bypass air inlet opening located in an area of the opening roller and operable to support the suction airflow into the fiber feed channel.

12. An apparatus according to claim 11, wherein the opening roller is disposed in an opening roller housing, which has a trash removal opening disposed ahead of the bypass air inlet opening with respect to an opening roller movement direction.

13. An apparatus for open-end spinning comprising:

an opening roller, a spinning rotor, and a fiber feed channel for transporting fibers using a suction airflow from the opening roller to the spinning rotor, wherein said fiber feed channel has a deflecting zone on its transport path formed by adjoining fiber feed channel sections defining fiber feed paths inclined with respect to one another, wherein a bypass opening for drawing off a part of the suction airflow is provided at the fiber feed channel, and wherein the fiber feed channel includes two channel sections which are connected together at a partition seam at which the bypass opening is located.

14. An apparatus according to claim 13, wherein one of the two channel sections disposed closer to the spinning rotor than the other of the two channel sections includes a recess area which widens toward the partition seam to form the bypass opening.

15. An apparatus according to claim 14, wherein said recess area is on a side of the fiber feed channel closest to the spinning rotor.

16. Open end spinning assembly comprising:

an opening roller, a spinning rotor, a fiber feed channel for transporting fibers from the opening roller to the spinning rotor, said fiber feed channel having a deflecting zone formed by adjoining fiber feed channel sections defining fiber feed paths inclined with respect to one another, a bypass air outlet opening for drawing off a part of the suction airflow in the fiber feed channel, said bypass air outlet opening being disposed downstream of the beginning of the deflecting zone, an opening roller housing for housing the opening roller, a trash removal opening in the opening roller housing, and a bypass air inlet opening in the opening roller housing disposed downstream of the trash removal opening and upstream of an entry end of the fiber feed channel.

17. An open-end spinning assembly according to claim 10, wherein the fiber feed channel narrows in a fiber transport direction and wherein the bypass air inlet opening is disposed upstream of a narrowest cross-section of the fiber feed channel.

18. An apparatus according to claim 17, wherein the bypass opening is an air inlet opening of an air outlet duct which is directed opposite to the transport direction of the fiber feed channel.

19. An apparatus according to claim 17, wherein the fiber feed channel comprises two channel sections and has at the deflecting zone a partition seam at which the bypass opening is located.

* * * * *